United States Patent [19]

Ohno

[11] Patent Number: 4,680,018

[45] Date of Patent: Jul. 14, 1987

[54] RECONFIGURABLE TOY ASSEMBLY

[75] Inventor: Kouzin Ohno, Tokyo, Japan

[73] Assignee: Takara Co., Ltd., Tokyo, Japan

[21] Appl. No.: 849,211

[22] Filed: Apr. 7, 1986

Related U.S. Application Data

[62] Division of Ser. No. 524,289, Aug. 17, 1983, Pat. No. 4,550,993.

[30] Foreign Application Priority Data

| | | | |
|---|---|---|---|
| Oct. 12, 1982 | [JP] | Japan | 57-154325[U] |
| Nov. 5, 1982 | [JP] | Japan | 57-167809[U] |
| Dec. 14, 1982 | [JP] | Japan | 57-188580[U] |
| Feb. 17, 1983 | [JP] | Japan | 58-21991[U] |

[51] Int. Cl.[4] ..... A63H 3/46; A63H 17/00

[52] U.S. Cl. ..... 446/376

[58] Field of Search ..... 446/376, 93, 97, 431, 446/465, 487, 470; D21/128, 150, 166

[56] References Cited

U.S. PATENT DOCUMENTS

| | | | |
|---|---|---|---|
| 4,095,367 | 6/1978 | Ogawa . | |
| 4,170,840 | 10/1979 | Ogawa . | |
| 4,183,173 | 1/1980 | Ogawa . | |
| 4,206,564 | 6/1980 | Ogawa . | |
| 4,307,533 | 12/1981 | Sims et al. . | |
| 4,516,948 | 5/1985 | Obara | 446/376 X |
| 4,530,670 | 7/1985 | Ohno | 446/94 |
| 4,571,203 | 2/1986 | Murakami | 446/376 X |
| 4,586,911 | 5/1986 | Murakami | 446/376 |

FOREIGN PATENT DOCUMENTS

| | | |
|---|---|---|
| 2059785 | 4/1981 | United Kingdom . |
| 2060414 | 5/1981 | United Kingdom . |
| 2088733 | 6/1982 | United Kingdom . |
| 2122908 | 1/1984 | United Kingdom . |

*Primary Examiner*—Mickey Yu

*Attorney, Agent, or Firm*—Price, Gess & Ubell

[57] ABSTRACT

A reconfigurable toy assembly is disclosed which is adapted to be reversibly transformed to provide two kinds of configurations entirely different from each other between a first position and a second position by only swinging operation. Typically, the reconfigurable toy assembly is constructed in such a manner to provide a vehicle form by folding the toy assembly and a robotic humanoid form by unfolding.

10 Claims, 28 Drawing Figures

RECONFIGURABLE TOY ASSEMBLY

This is a divisional application of United States patent application Ser. No. 524,289 filed Aug. 17, 1983, now U.S. Pat. No. 4,550,993.

BACKGROUND OF THE INVENTION

1. Field of the Invention

This invention relates to a reconfigurable toy assembly, and more particularly to a toy assembly which is adapted to be reversibly transformed to provide two kinds of configurations highly different from each other between a first position and a second position.

2. Description of the Prior Art

Various kinds of toys for children such as a toy vehicle, a toy robot and the like have appeared on the market. Such conventional toys are generally classified into two groups. One is a static toy group consisting of a toy robot, for example, having a robotic humanoid configuration and the like, and the other is a dynamic toy group consisting of a toy vehicle, a flying toy and the like. The former toys are generally constructed to allow children to take pleasure in their appearance and configuration whereas the latter ones are adapted to arouse children's surprise and interest in their motion and function. Accordingly, it will be noted that the both toys have interests highly different in nature from each other for children. This would be one of the reasons why children want toys of such two kinds. Thus, it is readily understood that the appearance of a toy which is capable of providing two reversibly transformable configurations entirely different from each other, for example, such as a robotic humanoid form and a vehicle form by simple operation will permit children's interest to be redoubled. Also, such reconfigurable toy will be rich in unexpectedness and originality.

While toys have been provided which can be transformed into various configurations, there is still a demand in the toy industry to provide novel and compact toys which can be transformed with ease by simple operation and manufactured with low costs.

BRIEF SUMMARY OF THE INVENTION

The present invention has been made in view of the foregoing.

Accordingly, it is an object of the present invention to provide a reconfigurable toy assembly which can be reversibly transformed to provide two kinds of configurations entirely different from each other between two positions.

It is another object of the present invention to provide a reconfigurable toy assembly of a simple construction which can be reversibly transformed by simple operation.

It is another object of the present invention to provide a reconfigurable toy assembly which can be manufactured with low costs.

It is another object of the present invention to provide a reconfigurable toy assembly which can be reversibly transformed between a static configuration and a dynamic configuration.

It is a further object of the present invention to provide a reconfigurable toy assembly which can be reversibly transformed between two positions to alternately provide a vehicle form and a robotic humanoid form.

It is still a further object of the present invention to provide a reconfigurable toy assembly of which parts are permanently interconnected to prevent from being lost.

In accordance with the present invention, there is provided a reconfigurable toy assembly comprising a frame means; a pair of first movable elements pivotally connected to the both sides of said frame means so as to be shiftable between a first position and a second position; a second movable element swingably mounted on said frame means so as to be shiftable between a first position and a second position; a third movable element swingably connected at one end thereof to said frame means so as to be shiftable between a first position and a second position; and a fourth movable element swingably attached to the other end of said third element so as to be shiftable between a first position and a second position; wherein said toy assembly provides a first configuration when said first, second, third and fourth elements are in the first position and said toy assembly provides a second configuration when said first to fourth elements are in the second position.

In a preferred embodiment of the present invention, the reconfigurable toy assembly may be reversibly transformed between a configuration of a vehicle such as a car, a sports car, a truck, a fire engine or the like and a robotic humanoid configuration. The toy assembly of such embodiment is constructed in a manner such that when the toy assembly is transformed to have a robotic humanoid configuration, the frame means forms a robotic humanoid trunk and the first to fourth movable elements respectively form robotic humanoid arms, head, legs and feet.

The invention therefore comprises the features of construction, combination of elements and arrangement of parts which will be exemplified in the construction hereinafter set fourth, and the scope of the invention is set forth in the claims appended hereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals are intended to designate like or corresponding parts throughout; wherein:

FIGS. 5A to 5D are diagrammatical views showing the manner of operation of reversibly transforming the reconfigurable toy assembly of the first embodiment between a vehicle form and a robotic humanoid form, wherein FIG. 5A is a diagrammatical view showing the general configuration of a vehicle, FIG. 5B is a diagrammatic view showing the operation of a head section of the vehicle, FIG. 5C is a diagrammatic view showing the operation of leg and foot sections of the vehicle and FIG. 5D is a diagrammatic view showing the general configuration of a robotic humanoid form;

FIGS. 10A to 10G are diagrammatical views showing the manner of operation of reversibly transforming the reconfigurable toy assembly between a vehicle form and a robotic humanoid form, wherein FIG. 10A is a diagrammatical view showing a state of upwardly swinging side plates of the vehicle, FIG. 10B is a diagrammatical rear view of the vehicle shown in FIG. 10A, FIG. 10C is diagrammatical view showing the operation of swinging chassis of the vehicle, FIG. 10D shows the operation of swinging a bonnet, a seat and a top member of the vehicle, FIG. 10E shows the operation of swinging the side plates and top member, FIG. 10F shows the operation of swinging the end portion of an arm section provided on the rear side of each side plate, and FIG. 10G shows the operation of swinging a link arm and a head section;

FIGS. 14A to 14C are diagrammatical views showing the manner of operation of reversibly transforming the reconfigurable toy assembly of the third embodiment between a sports car form and a robotic humanoid form, wherein FIG. 14A is a diagrammatic view showing the operation of swingably unfolding members for arm sections, a waist section, leg sections and foot sections of the toy robot, FIG. 14B is a diagrammatic view showing the operation of swingably unfolding the members for the leg and foot sections of the toy robot, and FIG. 14C is a diagrammatic view showing the operation of unfolding the members for the foot sections of the toy robot;

DETAILED DESCRIPTION OF THE PREFERRED EMBODIMENTS

Now, a reconfigurable toy assembly according to the present invention will be hereinafter described by way of example with reference to the accompanying drawings.

Figure 1:
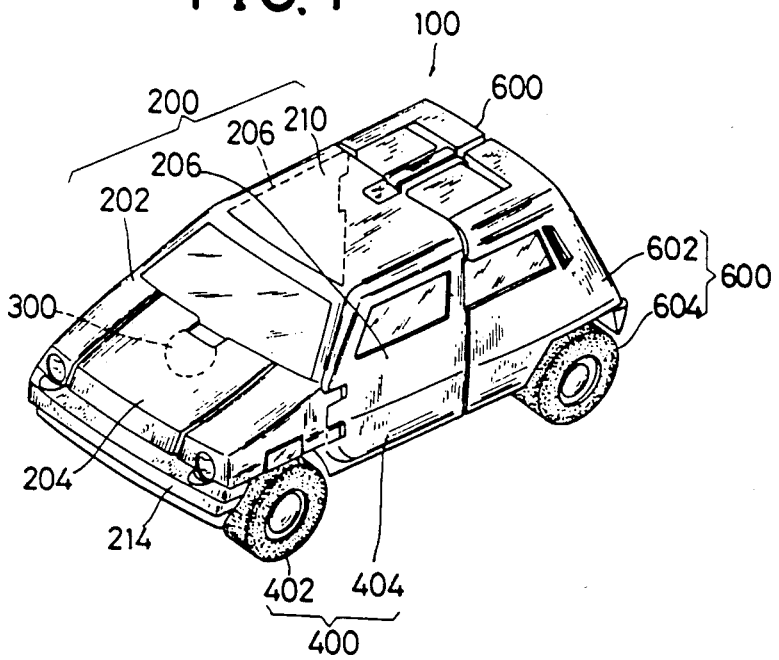
FIG. 1 is a perspective view illustrating a first embodiment of a reconfigurable toy assembly according to the present invention which is constructed to be reversibly transformed between a car or vehicle form and a robotic humanoid form, wherein the toy assembly is folded to provide a vehicle configuration.
Figure 2:
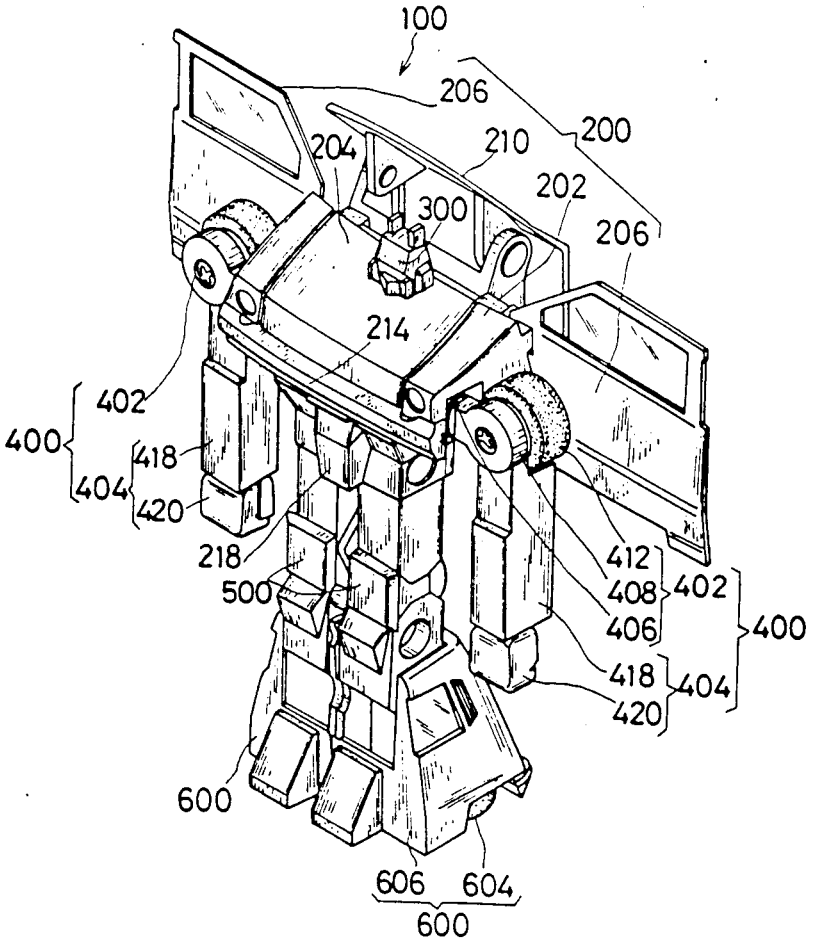
FIG. 2 is a perspective view showing the reconfigurable toy assembly of the first embodiment which is unfolded to provide a robotic humanoid configuration.

FIGS. 1 to 4 illustrate a first embodiment of a reconfigurable toy assembly according to the present invention, wherein the toy assembly is generally designated by reference numeral 100. The present embodiment is adapted to be reversibly transformed between a vehicle configuration and a robotic humanoid configuration. More particularly, the toy assembly of the embodiment, as shown in FIGS. 1 and 2, is constructed to provide a car form and a robotic humanoid form when it is folded and unfolded, respectively.

The toy assembly 100, as shown in FIGS. 1 to 4, generally comprises a trunk section 200, a head section 300 swingably mounted on the upper portion of the trunk section 200, a pair of arm sections 400 swingably connected to the both sides of the trunk section 200, a pair of leg sections 500 swingably secured to the lower portion of the trunk section 200, and a pair of foot sections 600 swingably connected to the leg sections 500.

The trunk section 200 is adapted to constitute the front portion of a vehicle configurated when the toy assembly is folded, and comprises a bonnet member 202 having a hood 204 vertically swung in the longitudinal direction of the toy vehicle, door members 206 pivotally mounted through pins 208 on the both sides of the rear portion of the bonnet 202 so as to be horizontally swingable about the pins 208, and a roof member 210 pivotally mounted through pin 212 on the rear portion of the bonnet 202. The trunk section 200 also includes a front bumper 214 and a supporting member 216 (FIG. 4) provided on the inside of the bumper 214. The supporting member 216 has a member 218 constituting the waist portion of the toy robot pivotally connected thereto through a pin-like projection 220 provided on the inside of the member 216 so as to be vertically longitudinally swingable about the projection 220.

The head section 300 is formed into a robotic humanoid shape and pivotally connected through a pin 302 (FIG. 4) to the hood 204 so as to be vertically longitudinally swung with respect to the hood.

The arm sections 400 each comprise a wheel 402 and an arm 404. Each of the wheels 402 includes a supporting member 406 pivotally connected to the side portion of the bonnet member 202 so as to be vertically laterally swingable with respect to the hood 204, a stay member 408 connected through a screw 410 to the supporting member 406 to be rotatable about the screw 410 with respect to the member 406 and a tire member 412 mounted on the stay 408 by means of a pin 414 and a screw 416 so as to be rotatable with respect to the stay 408. The wheel 402 is adapted to constitute a front wheel of the toy vehicle configurated by folding the toy assembly. Each of the arms 404 includes an arm member 418 swingably secured at one end thereof between the stay member 408 and the tire member 412 by means of the pin 414 and screw 416 in a manner to be interposed between the members 408 and 412. The arm 404 also includes a hand member 420 rotatably fitted in the other end of the arm member 418. The arm 404 is adapted to constitute the lower portion of the toy vehicle formed by folding the toy assembly.

The leg sections 500 are fixedly secured on the both sides of the lower portion of the waist member 218 of the trunk section 200 through a screw 502 and cap members 504. The leg sections 500 are adapted to be vertically longitudinally swung through the waist member 218 with respect to the trunk section 200 and received in the trunk section when the toy assembly is folded to form the vehicle configuration.

Figure 4:
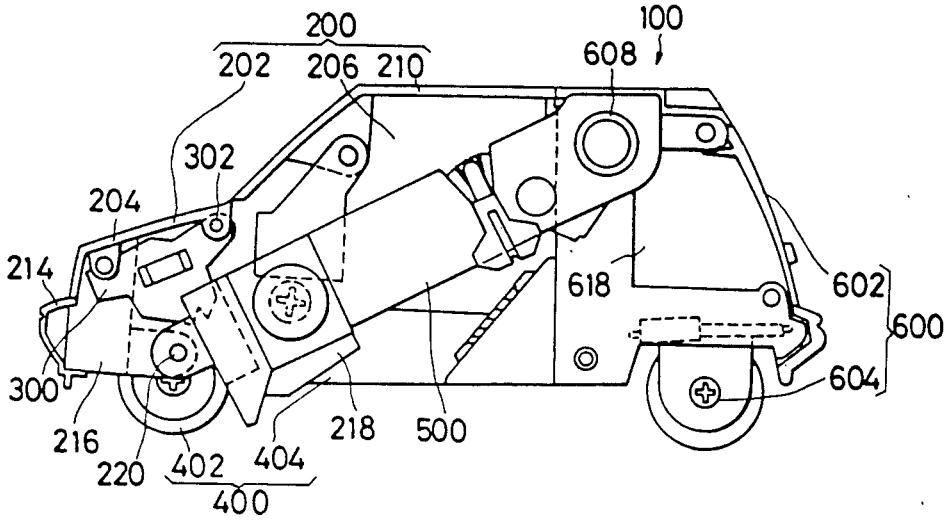
Fig. 4 is a diagrammatical view showing the inner arrangement of the reconfigurable toy assembly of the first embodiment which is folded to provide a vehicle form.
Figure 3:
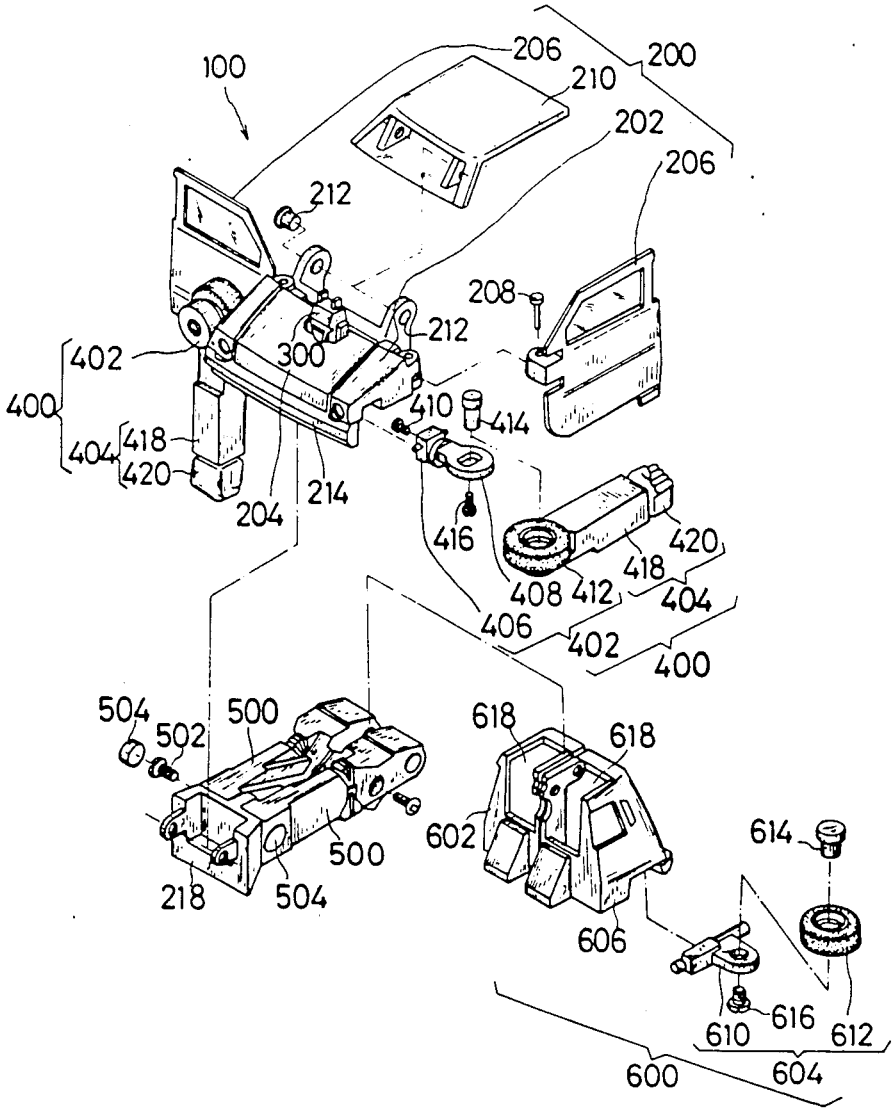
FIG. 3 is an enlarged exploded perspective view showing in detail constituent elements of the reconfigurable toy assembly of the first embodiment, and combination and arrangement thereof.

The foot sections 600 each comprises a foot 602 and a wheel 604 (FIGS. 3 and 4). The foot 602 includes a foot member 606 pivotally connected through a pin 608 to the corresponding leg section 500 so as to be vertically longitudinally swung about the pin 608 with respect to the leg section 500. The wheel 604 includes a stay member 610 connected to the lower side of the rear portion of the foot member 606 so as to be vertically laterally swung with respect to the foot member 606 and a tire member 612 rotatably connected to the stay member 610 by means of a pin 614 and a screw 616. The wheel 604 is adapted to constitute a rear wheel of the toy vehicle configurated when the toy assembly is folded.

The arms sections 400 and the legs sections 500 approximate the location of the vehicle frame in a vehicle mode of operation.

The manner of operation of the toy assembly shown in FIGS. 1 to 4 will be hereinafter described with reference to FIGS. 5A to 5D.

The toy assembly in the form of a toy vehicle (FIG. 1) obtained by folding is unfolded in turn in a manner as shown in FIGS. 5A to 5D to be transformed into a toy robot shown in FIG. 2.

Figure 5A:
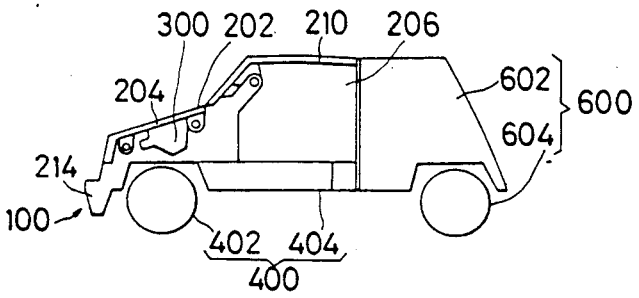

More particularly, in the toy vehicle shown in FIG. 1, firstly the hood 204 is vertically forwardly swung to open the trunk section 200 and the head section 300 is vertically forwardly swung to be upright with respect to the hood 204, as shown in FIG. 5A. Then, the hood is vertically backwardly swung to the original position to allow the head to be in an upright position.

The hood 204 provides the chest portion in the robot mode of operation.

Figure 5B:
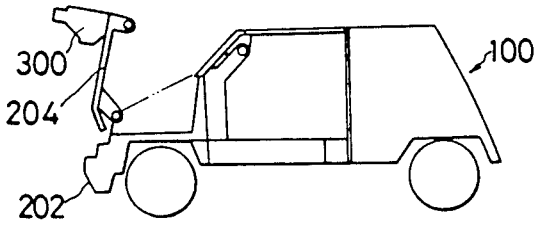
Figure 5C:
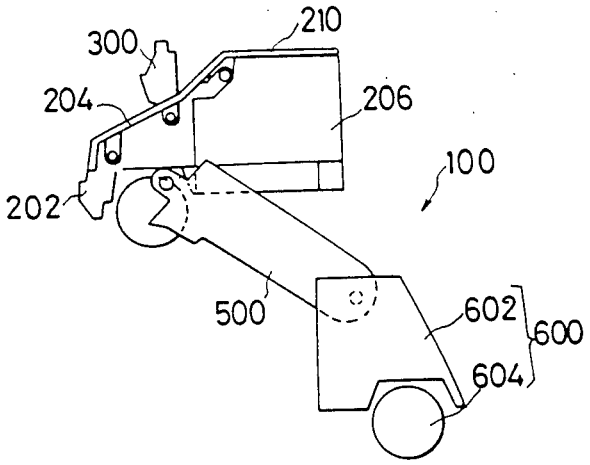
Figure 5D:
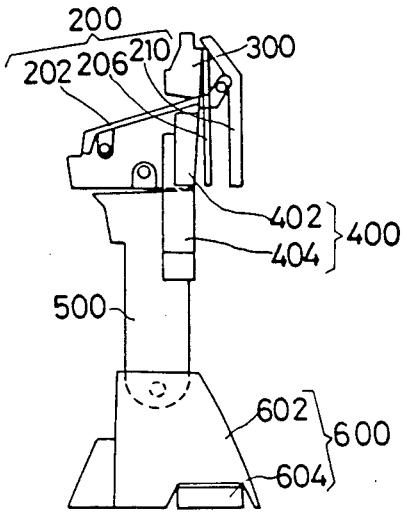

Subsequently, the leg sections 500 received in the trunk section 200 are downwardly forwardly swung together with the foot sections 600 to be exposed to the exterior of the trunk section 200 and then are in an upright position, as shown in FIG. 5D. Then, the arm sections 400 forming the lower portion of the toy vehicle are vertically forwardly swung to be upright and rotated together with the tire members 412 and stay members 408 with respect to the supporting member 406 to allow the tires 412 to be positioned on the rear side of the stays 408 and allow the arms 404 to be in an upright position.

The exterior housing of the vehicle mode constitutes the trunk 200 and the foot section 600.

Furthermore, as shown in FIG. 5C, each of the wheels 604 constituting the rear wheels of the toy vehicle is vertically inwardly swung to horizontally receive the stay 610 and tire 612 in the lower portion of each of the foot members 606 so that the stay and tire are invisible form the outside.

Finally, the door members 206 in a closed state as shown in FIGS. 5A to 5C are horizontally forwardly rotated to be opened as shown in FIG. 5D and the roof member 210 is vertically backwardly rotated to be upright. Thus, the toy vehicle shown in FIG. 1 is transformed into the toy robot shown in FIG. 2.

Reconfiguration of the toy assembly 1 from the so-formed toy robot to the toy vehicle can be readily carried out by reversely practicing the above-mentioned operation. Thus, it will be readily understood that the toy assembly of the present embodiment can be reversibly transformed between the toy vehicle and the toy robot.

It is a matter of course that the toy vehicle configurated by folding the toy assembly of the embodiment illustrated is not limited to such two-box type car and may be in the form of any of other vehicles such as a one-box type car, a three-box type car, a truck, a special equipment vehicle and the like.

The present embodiment may be constructed in a manner to receivably arrange a bike, a motorcycle and the like in the foot section, for example, in the interior 618 of each foot section. Also, the toy assembly of the embodiment may be provided with any suitable power means which allows the assembly to be automatically moved. It is also possible to provide the toy assembly with a gun or the like. Furthermore, the embodiment is constructed to swingably connect the leg sections through the waist member indirectly to the trunk section, however, the leg sections may be swingably connected directly to the trunk section.

FIGS. 6 to 9 illustrate a second embodiment of a reconfigurable toy assembly according to the present invention, which is constructed to be reversibly transformed between a vehicle form and a robotic humanoid form. In the second embodiment, a vehicle configured by folding the toy assembly is in the form of a truck.

Figure 9:
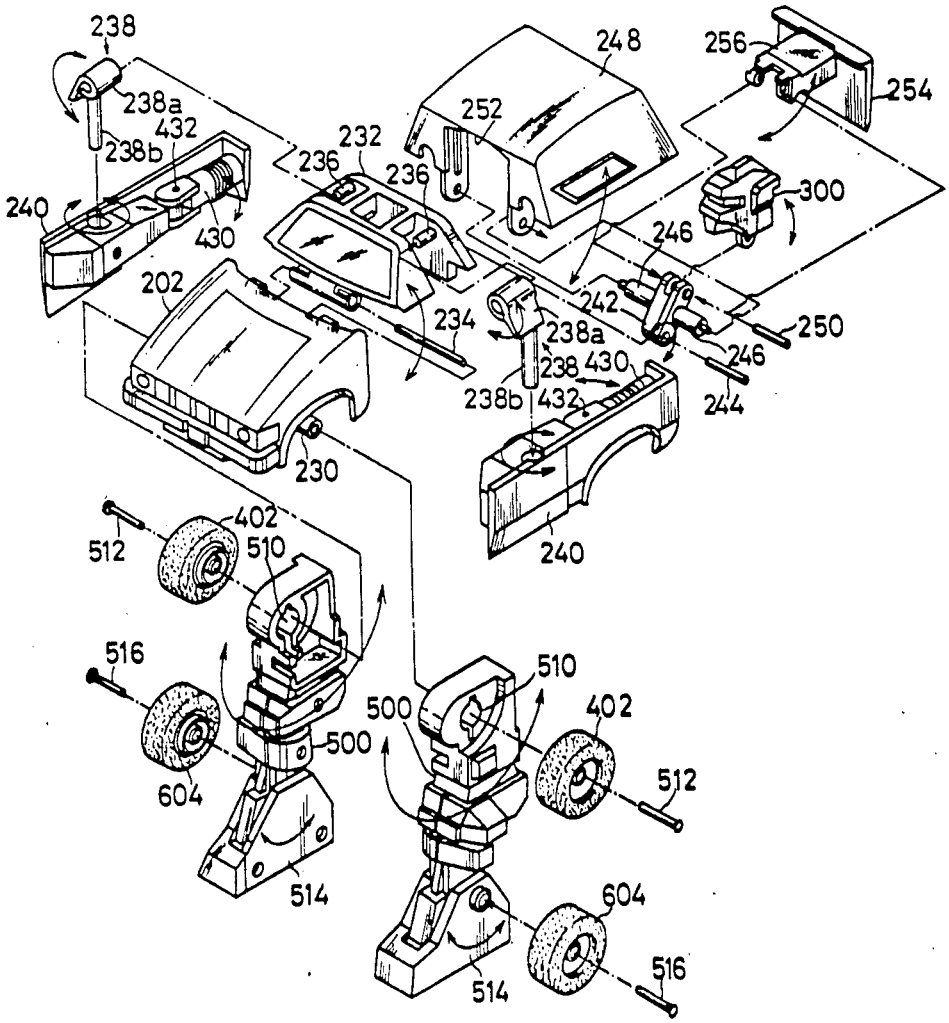
FIG. 9 is an enlarged exploded perspective view showing in detail parts of the reconfigurable toy assembly of the second embodiment, and combination and arrangement thereof.

The toy assembly of the second embodiment, as detailedly shown in FIG. 9, includes a bonnet 202 having a pair of pin-like projections 230 arranged therein which horizontally extend in the lateral directions of the toy vehicle. The bonnet 202 forms a portion of the robotic trunk in the robot configuration. The projections 230 each have a chassis 500 fitted thereon through a hole 510 formed at one end of the chassis. The chassis element 500 is formed into a robotic humanoid leg and fitted on the projection 230 so as to be longitudinally downwardly swingable at an angle of about 180 degrees, about the projection 230. The chassis 500, when the toy assembly 100 is in the form of a toy shape shown in FIG. 9, is horizontally arranged to allow the other end (free end) thereof to be positioned at the rear portion of the vehicle. Each of the projections 230 also has a front wheel 402 fitted thereon through a pin 512 at the outside of the chassis 500.

Each of the chassis 500 has a rear chassis member 514 pivotally connected to the other end thereof through a pin 516 so that the rear chassis member 514 may be longitudinally downwardly swung at an angle about the pin 516. The rear chassis member 514 has a rear wheel 604 rotatably mounted on the outside thereof by means of the pin 516. Each of the rear chassis member 514 is formed into a robotic humanoid foot shape.

The bonnet 202 has a seat member 232 connected at the front end thereof to the upper portion of the rear end of the bonnet 202 by means of a pin 234 to allow the member 232 to be swung at an angle of about 90 degrees between the horizontal position and the downwardly vertical position about the pin 234. The seat member 232 is formed on the both sides of the rear portion thereof with a pair of horizontal projections 236 forwardly extending in parallel with each other, each of which has a stay member 238 of a substantially T-shape fitted at the horizontal portion 238*a* thereof on the projection 236 so as to be rotatable thereabout. The stay members 238 each have a side plate 240 fitted on the vertical portion 238*b* thereof so as to be rotatable about the vertical portion 238*b*. Thus, the side plate 240 is adapted to be outwardly laterally swung at the free end (lower end) thereof about the horizontal portion 238*a* of the stay member and horizontally rotated at an angle of 360 degrees about the vertical portion 238*b* of the stay member. The side member or element 240 has an arm section 400 of the toy robot formed on the inner side thereof, the arm section having one end 430 inwardly swung about a pin 432.

The seat member 232 has a link arm 242 pivotally connected at one end thereof to the lower portion of the rear end of the member 232 by means of a pin 244 to permit the free end thereof to be swung backwardly from its upwardly vertical position about the pin 244. The link arm 242 is formed on the both sides of the central portion thereof with a pair of shafts 246 horizontally extending in the lateral directions opposite to each other. On each of the shafts 246, a top member 248 is fitted at the lower portion of the front end thereof to allow the rear end (free end) thereof to be downwardly swung backward from its horizontal position. Also, the link arm 242 has a head section 300 pivotally connected at the lower end portion thereof to the other end (free end) of the link arm by means of a pin 250 so as to be longitudinally upwardly rotatable about the pin 250. The head section or element 300 is formed to have a robotic humanoid head shape. In the embodiment illustrated, the head section 300 is adapted to be received through a cutout 252 formed at the top member 248 in the member 248 when the toy assembly is formed into the toy vehicle, however, the embodiment may be constructed to receive the head section 300 in the seat member 232. The link arm 242 also has a rear fender member 254 pivotally connected at the horizontally projecting portion 256 thereof to the free end of the link arm 242 by the pin 250. The rear fender 254, when the toy assembly is folded to form the toy vehicle, defines the rear portion of the top member 248; so that the rear chassis element or member 514 connected to the chassis or element 500 may abut at the end portion thereof against the inner portion of the fender 254 to keep themselves in a horizontal position, when the chassis 500 are swung to the rear side of the top member 248 and can form robotic feet in a robot configuration.

The manner of operation of the toy assembly of the second embodiment constructed in the manner as mentioned hereinbefore will now be described with reference to FIGS. 10A to 10G.

Figure 6:
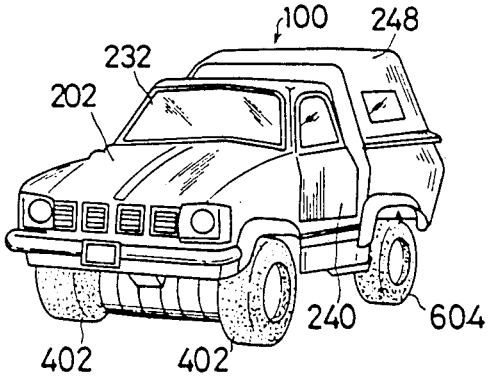
FIG. 6 is a perspective view illustrating a second embodiment of a reconfigurable toy assembly according to the present invention which is constructed to be reversibly transformed between a truck or vehicle configuration and a robotic humanoid configuration, wherein the toy assembly is folded to provide a truck form.
Figure 7:
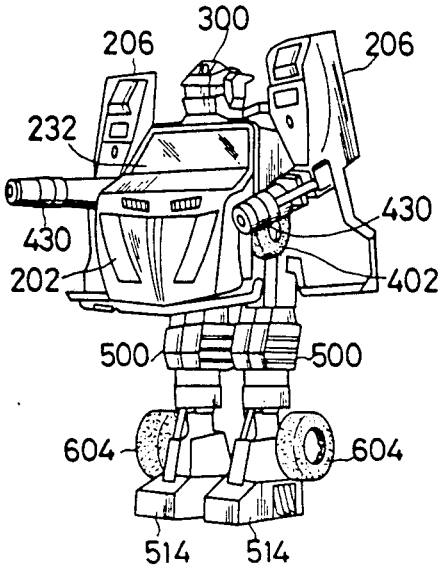
FIG. 7 is a perspective view showing the reconfigurable toy assembly of the second embodiment which is unfolded to provide a robotic humanoid configuration.
Figure 8:
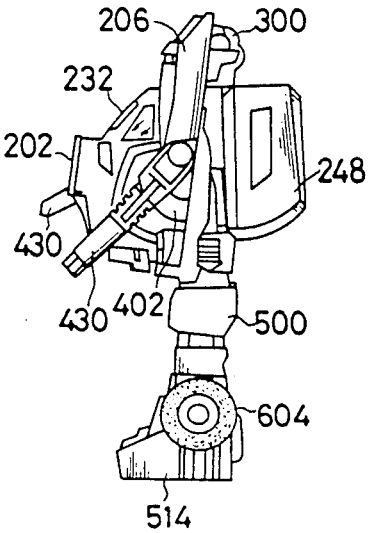
FIG. 8 is a side elevation view of the toy assembly of a robotic humanoid configuration shown in FIG. 7.
Figure 10A:
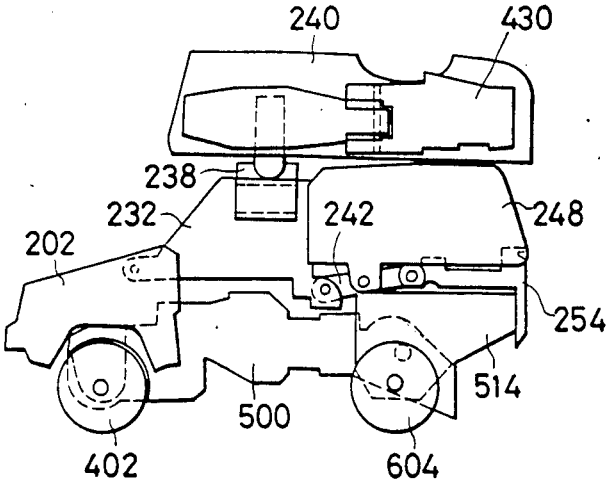
Figure 10B:
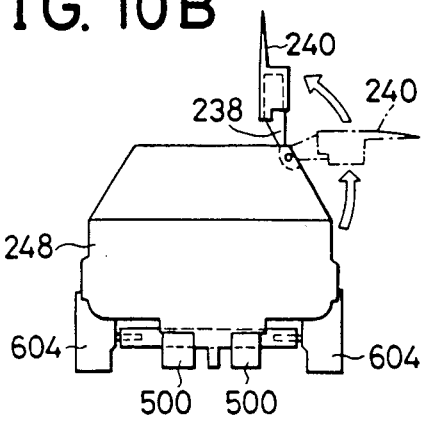

In order that the toy assembly is transformed from the vehicle form shown in FIG. 6 into the robotic humanoid form of FIGS. 7 and 8, firstly the side plates 240 are upwardly swung above the seat member 232 and the top member 248, as shown in FIGS. 10A and 10B. This allows the arm section 400 formed on the inner surface of each side plate to be exposed.

Figure 10C:
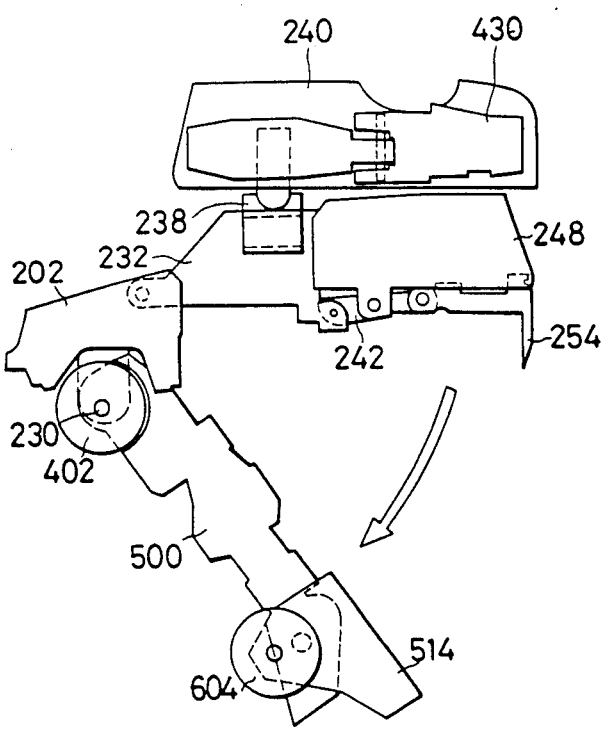
Figure 10D:
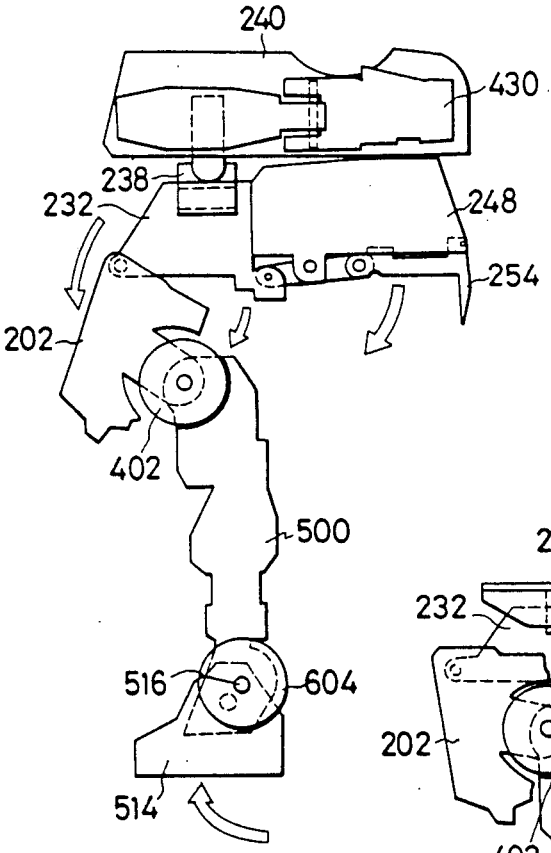

Then, each of the chassis 500 is swung about the pin-like projection 230 in the clockwise direction, as shown in FIG. 10C. At this point, the outer end portion of each of the rear chassis member 514 is still in the position along the axis of the chassis 500. After the chassis 500 is swung to be in a state perpendicular with respect to the bonnet 202, the rear chassis member 514 is swung in the clockwise direction to be perpendicular to the axis of the chassis 500 as shown in FIG. 10D.

Figure 10E:
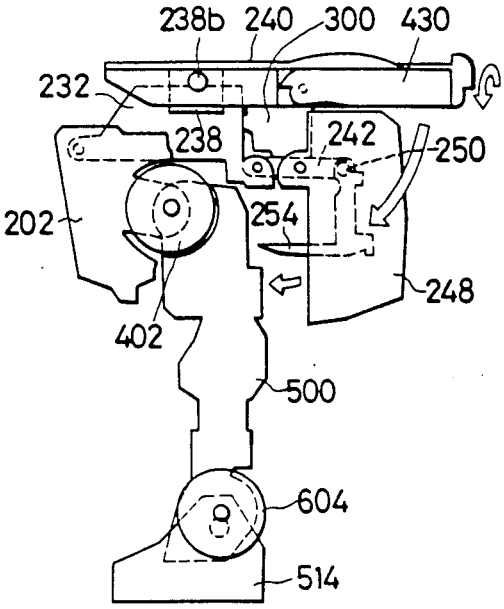
Figure 10F:
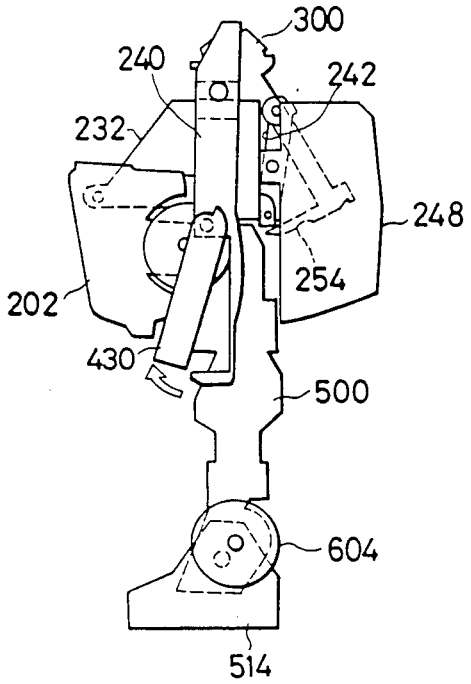
Figure 10G:
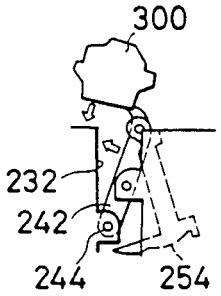

Subsequently, the bonnet 202 is swung in the counter-clockwise direction about the projection 230 and the seat member 232 is concurrently swung in the clockwise direction to be in a state contacting with the upper end portion of each chassis 500 (FIG. 10D), as shown in FIG. 10E. Then, the top member 248 is swung in the clockwise direction about the pin 250 toward the side of the chassis 500 to constitute the rear portion of the toy robot, as shown in FIG. 10E. And, the side plates 240 are swung to be horizontally arranged with respect to the both sides of the seat member 232 as shown in FIG. 10E and then swung in the counter-clockwise direction in FIG. 10E about the vertical portion of the stay member 238 to be in a vertical position, as shown in FIG. 10F. Thereafter, the end portion of each of the arm sections 400 is swung at a desired angle in the clockwise direction as shown in FIG. 10F. Finally, the link arm 242 is swung in the counter-clockwise direction about the pin 244 as shown in FIG. 10G to allow the head section 300 to be arranged on the seat member 232 (FIG. 10F). Thus, the toy assembly 100 is transformed into the robotic humanoid configuration shown in FIGS. 7 and 8, wherein the leg, trunk and arm sections are respectively constituted by the chassis, rear chassis member; bonnet, seat member and top member; and side plates.

Reconfiguration of the toy assembly from the so-formed robotic humanoid shape to the vehicle form shown in FIG. 6 can be readily accomplished by operating the assembly in a manner reverse to that as described hereinbefore.

Figure 11:
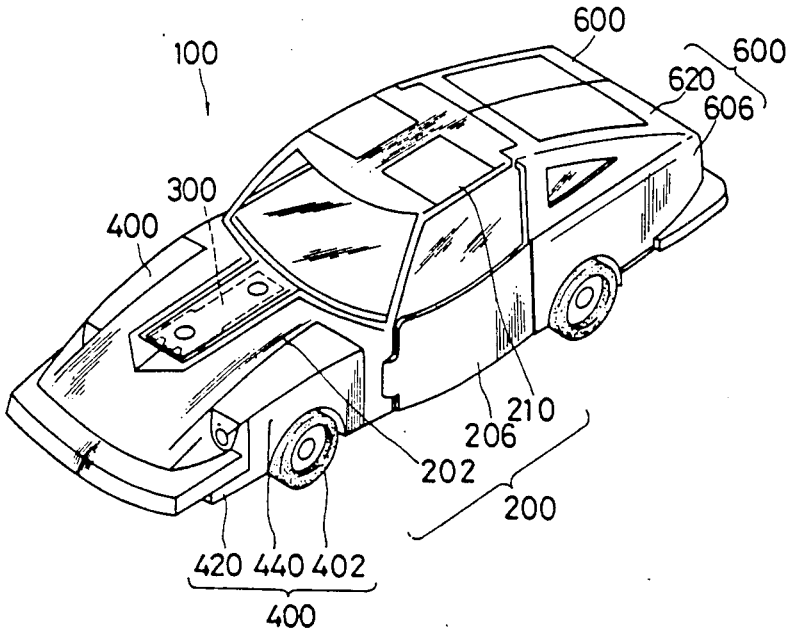
FIG. 11 is a perspective view illustrating a third embodiment of a reconfigurable toy assembly according to the present invention which is constructed to be reversibly transformed between a sports car configuration and a robotic humanoid configuration, wherein the toy assembly is folded to have a sports car configuration.
Figure 12:
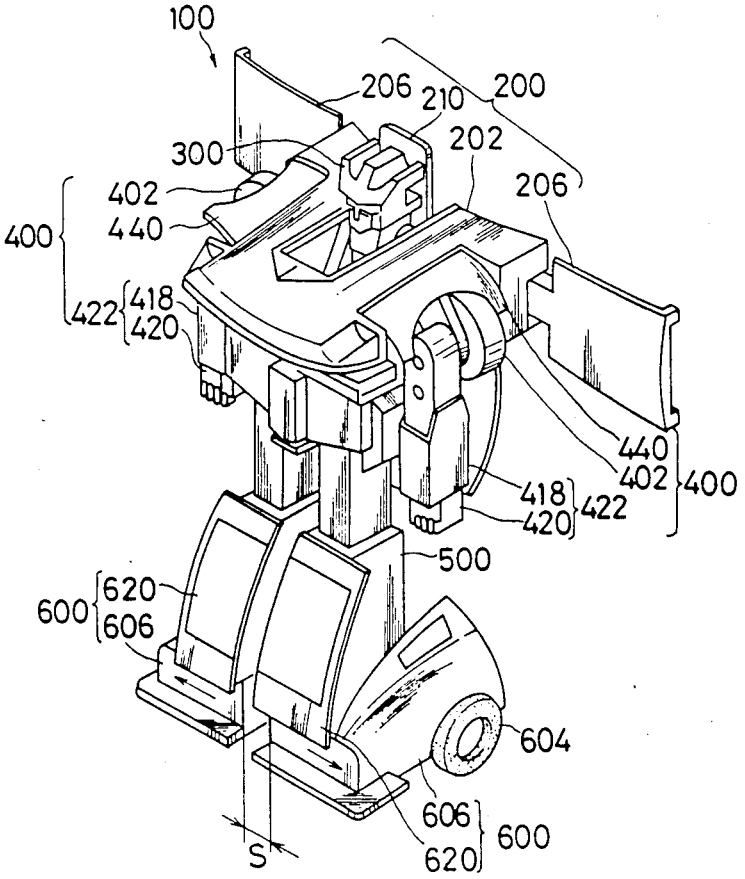
FIG. 12 is a perspective view showing the reconfigurable toy assembly of the third embodiment which is unfolded to provide a robotic humanoid configuration.
Figure 13:
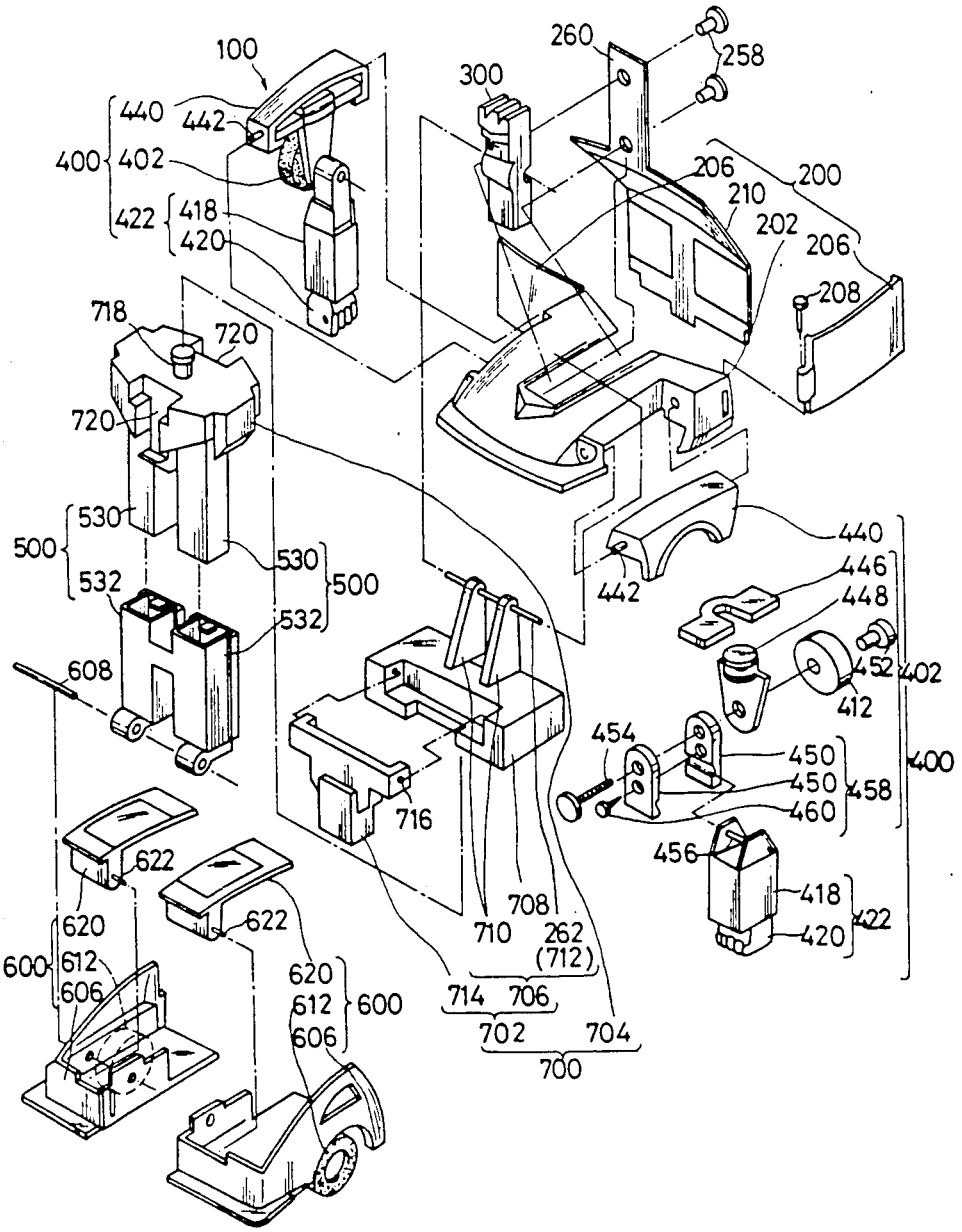
FIG. 13 is an enlarged exploded perspective view showing in detail parts of the reconfigurable toy assembly of the third embodiment, and combination and arrangement thereof.

A third embodiment of a toy assembly according to the present invention is illustrated in FIGS. 11 to 13, which is also constructed to be reversibly transformed between a vehicle form and a robotic humanoid form. The toy assembly of the third embodiment is adapted to provide a toy vehicle having a car form as shown in FIG. 11 when it is folded and a toy robot of a robotic humanoid form when being unfolded.

The toy assembly 100 of the illustrated embodiment, as shown in FIGS. 11 to 13, comprises a trunk section 200, a head section 300 swingably mounted on the upper portion of the trunk section 200, a pair of arm sections 400 swingably connected to the both sides of the trunk section 200, a waist section 700 swingably connected to the lower portion of the trunk section, a pair of leg sections 500 connected to the lower portion of the waist section 700 and a pair of foot sections 600 swingably connected to the leg sections 500.

The trunk section 200 includes a bonnet member 202 constituting the front portion of the vehicle configured by unfolding the toy assembly, a pair of door members 206 pivotally mounted on the both sides of the rear portion of the bonnet 202 by means of pins 208 so as to be horizontally swingable about the pins and a roof member 210 pivotally secured to the upper portion of the rear side of the bonnet 202 so as to be vertically longitudinally swung.

The head section 300 is formed to have a robotic humanoid head shape. The head section 300 is fixed through a screw 258 to a projection 260 formed at the front end of the roof member 210 and is pivotally connected through a shaft 262 to the center of the rear portion of the bonnet 202 so as to be vertically longitudinally swingable about the shaft 262 with respect to the bonnet 202.

The arm sections 400 each comprises a fender member 440 pivotally secured to the central portion of the side of the bonnet 202 through a pin-like projection 442 so as to be vertically inwardly swingable with respect to the bonnet 202; a wheel 402 including a supporting plate 446 fittedly held in the inside of the fender 440, a stay member 448 rotatably secured to the supporting plate 446 and a tire member 412 rotatably mounted on the stay member 448 through a pair of mounting plate members 450 by means of a pin 452 and a screw 454, the wheel 402 constituting a front wheel of the vehicle formed by folding the toy assembly; an arm member 418 swingably connected through a pin 456 to the lower end of a mounting plate 458 integrally formed of the mounting plate members 450 by means of a screw 460; and a hand member 420 rotatably fitted in the other end of the arm member 418. The arm sections 400 are adapted to constitute the lower portion of the vehicle when the toy assembly is folded.

The waist section 700 comprises an upper waist 702 and a lower waist 704. The upper waist 702 includes a base 706 comprising a base member 708, a pair of stay members 710 arranged on the base member 708 so as to extend upwardly in parallel with each other and a shaft 712 secured to the stay members 710 in a manner to horizontally extend through the stay members; and a stopper 714 pivotally connected to the front surface of the base 706 through pins 716 so as to be vertically swingable about the pins 716. The lower waist 704 comprises a member having a projection 718 formed on the upper surface thereof which is adapted to be fitted in the lower surface of the base member 708 of the upper waist 702 so that the lower waist member 704 may be horizontally rotated about the projection 718 with respect to the upper waist 702. The lower waist 704 also has recesses 720 formed on the front and rear surfaces thereof which are adapted to be engaged with the stopper 714. The waist section 700 is pivotally connected through the shaft 712 to the center of the upper portion of the bonnet 202 and is adapted to be received in the trunk section 200 when the toy assembly is folded.

The leg sections 500 comprise a pair of upper leg members 530 fixed on the lower side of the lower waist 704 and a pair of lower leg members 532 slidably connected with respect to the upper leg members 530. Thus, it will be noted that the leg sections 500 are vertically longitudinally swung through the waist section 700 with respect to the trunk section 200. Also, the leg sections 500 are adapted to be received in the trunk section 200 and the foot sections 600 described hereinafter, when the toy assembly 100 is folded.

The foot sections 600 include a apir of foot members 606 pivotally connected through a horizontal pin member 608 to the lower leg members 532 so as to be vertically longitudinally swingable about the pin 608 with respect to the leg sections 500. The foot members 606 are adapted to constitute the rear portion of the vehicle configured by folding the toy assembly 100. The foot sections 600 also include a pair of rear door members 620 pivotally connected through pins 622 provided at the members 622 to the foot members 606 so as to be vertically longitudinally swingable with respect to the foot members and a pair of tire members 612 each rotatably mounted on the outer side surface of each of the foot members 606 and adapted to constitute a rear wheel 604 of the vehicle formed by folding the toy assembly.

The manner of operation of the toy assembly of the third embodiment mentioned above will be hereinafter described with reference to FIGS. 14A to 14C.

Figure 14A:
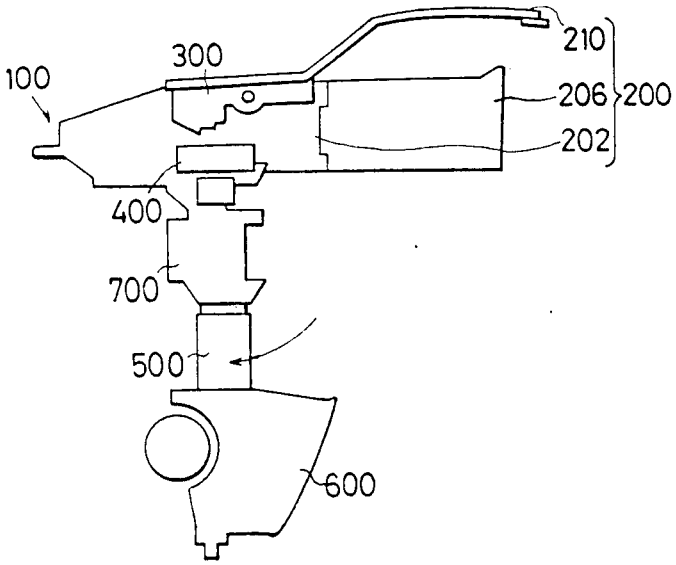
Figure 14B:
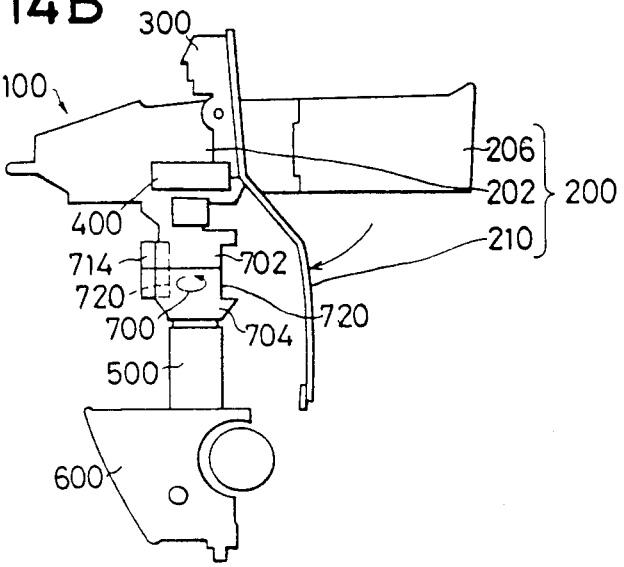
Figure 14C:
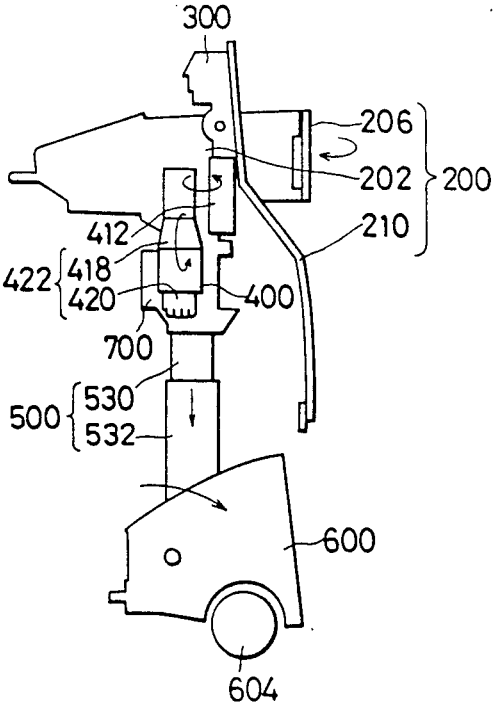

Generally speaking, the toy assembly 100 folded to configure the vehicle form shown in FIG. 11 is unfolded in turn as shown in FIGS. 14A to 14C to be transformed into the robotic humanoid form shown in FIG. 12.

More particularly, the toy assembly in the form of the vehicle shown in FIG. 11 is firstly unfolded in a manner to straightly stretch the arm sections 400 folded and received in the trunk section 200 and then laterally swing the arm sections 400 to render the arm sections horizontal. Then, the leg sections 500 are longitudinally downwardly swung through the waist section 700 together with the foot sections 600 to be in a state of downwardly extending from the lower surface of the bonnet 202. Then, the stopper 714 is vertically forwardly swung as shown in FIG. 14B to be disengaged from the recess 720, and thereafter, the lower waist 704 is horizontally rotated at an angle of 180 degrees with respect to the upper waist 702 to reverse the waist section 700, leg sections 500 and foot sections 600. Then, the stopper 714 is engaged with the recess 720 and the roof member 210 is vertically downwardly swung to allow the head section 300 to stand upright on the bonnet 202.

Then, as shown in FIG. 14C, the door members 206 constituting a part of the trunk section 200 are horizontally forwardly swung to outwardly project from the bonnet 202, to thereby open the trunk section 200; and the arm sections 400 received in the lower portion of the toy vehicle are horizontally rotated with respect to the supporting member 446 together with the tire members 412 and stay members 448 to allow the tire member 412 to be in a rear position. Further, the arm sections 400 are vertically inwardly swung together with the fender members 440 to be in an upright state with respect to the bonnet 202.

Furthermore, as shown in FIG. 14C, the foot members 600 constituting the rear portion of the vehicle are downwardly slided with respect to the upper legs 530 together with the lower legs 532 and then swung to be in a horizontal state, to thereby be perpendicular to the leg sections 500.

Finally, the foot sections 600 closely contacting with each other are laterally outwardly slided to be spaced from each other to define an interval S therebetween. Thus, the toy assembly is transformed from the vehicle configuration shown in FIG. 11 into the robotic humanoid configuration shown in FIG. 12.

Reconfiguration of the toy assembly 100 from the so-formed robotic humanoid shape to the vehicle shape can be readily accomplished by reversely practicing the above-mentioned operation.

The venicle configured by folding the toy assembly of this embodiment has a sports car configuration, however, it may be in the form of any one of other vehicles such as a one-box type car configuration, a three-box type car configuration, a truck configuration and the like.

Figure 15:
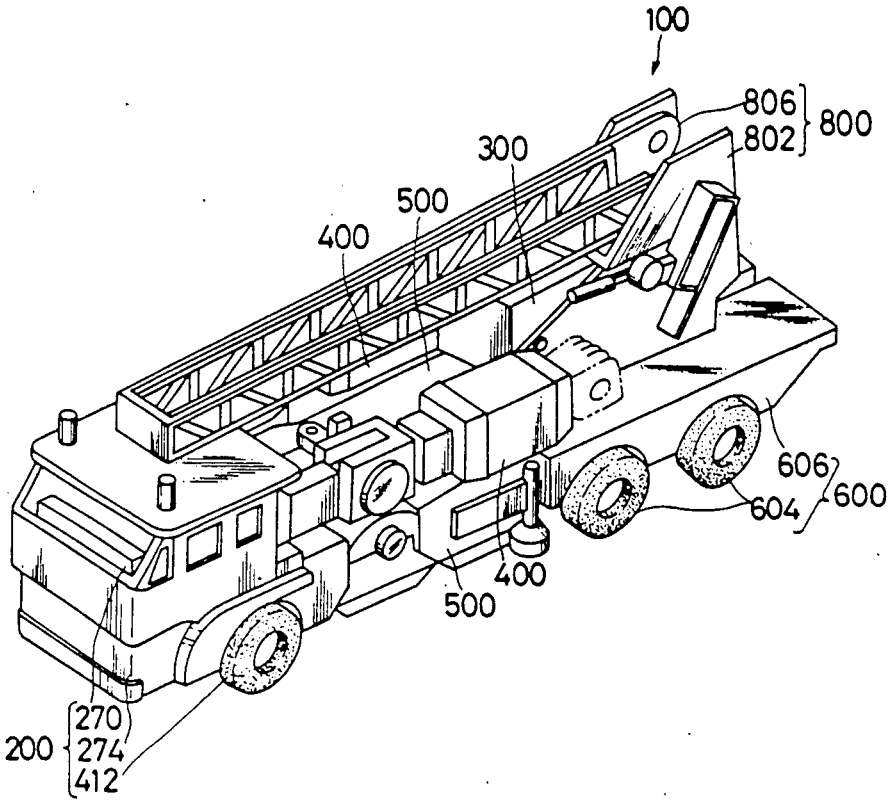
FIG. 15 is a perspective view illustrating a fourth embodiment of a reconfigurable toy assembly according to the present invention which is constructed to be reversibly transformed between a fire engine configuration and a robotic humanoid configuration, wherein the toy assembly is folded to provide a fire engine form.
Figure 16:
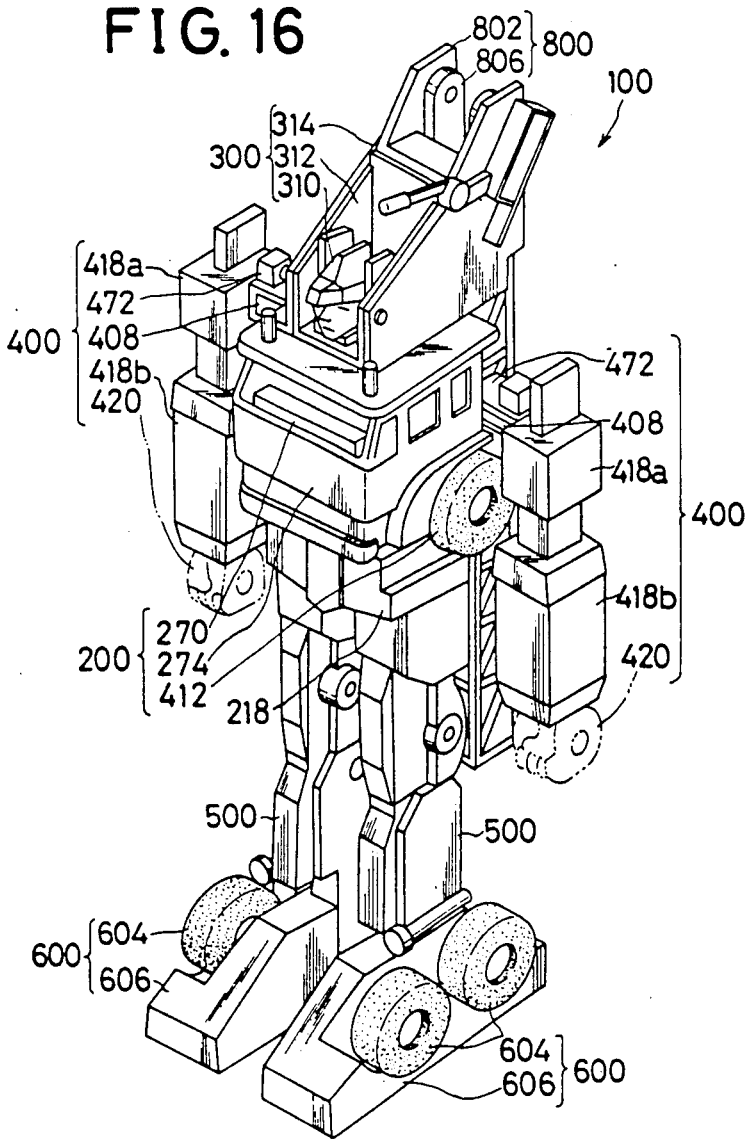
FIG. 16 is a perspective view showing the reconfigurable toy assembly, of the fourth embodiment which is unfolded to have a robotic humanoid configuration.
Figure 17:
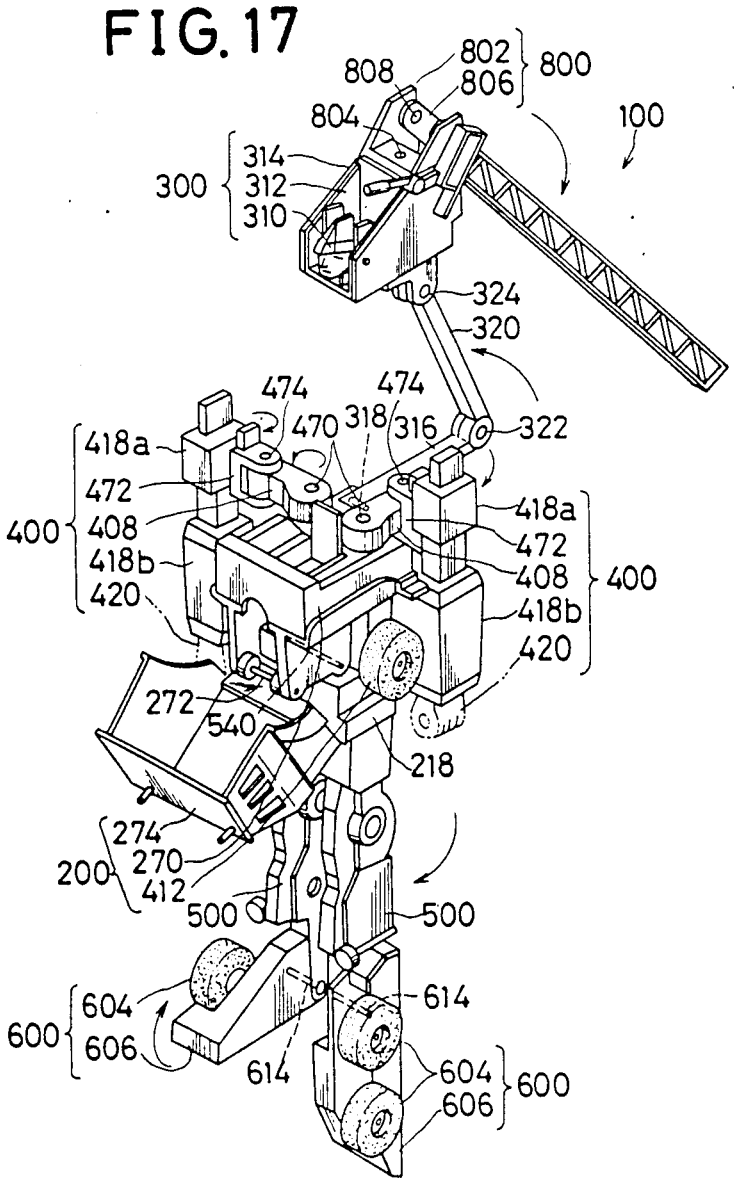
FIG. 17 is a diagrammatical perspective view showing a process of transforming the reconfigurable toy assembly from a fire engine form into a robotic humanoid form.

FIGS. 15 to 17 illustrate a fourth embodiment of a toy assembly according to the present invention. The toy assembly of the fourth embodiment is constructed to provide such a fire engine configuration as shown in FIG. 15 when it is folded and such a robotic humanoid configuration as shown in FIG. 16 when it is unfolded.

The toy assembly 100, as shown in FIGS. 15 to 17, comprises a trunk section 200, a head section 300 swingably and movably mounted on the trunk section 200, a pair of arm sections 400 swingably connected to the both sides of the trunk section 200, a pair of leg sections 500 swingably connected to the lower portion of the trunk section 200, a pair of foot sections 600 each swingably connected to the lower portion of the corresponding leg section 500, and a back section 800 swingably connected to the head section 300.

The trunk section 200 comprises a trunk body 270 constituting a front chassis of the toy fire engine, a cab member 274 connected through a pin 272 to the front portion of the trunk body 270 so as to be vertically longitudinally swingable about the pin 272 with respect to the trunk body 270, and tire members 412 rotatably mounted on the both sides of the lower portion of the trunk body 270. The trunk section 200 is adapted to constitute the front portion and front wheel of the toy fire engine.

The head section 300 comprises a head member 310 formed into a robotic humanoid head shape, a supporting member 312 of a U-shape in section on which the head member 310 is fixedly supported, and a base member 314 for holding the head member 310 and the supporting member 312 thereon. The head section 300 is connected to the trunk section 200 so as to be vertically longitudinally swingable with respect to the trunk section by means of a first rod-like link member 316 pivotally connected at one end thereof through a pin 318 to the upper portion of the rear side of the trunk section 200 so as to be vertically longitudinally swingable about the pin 318 and a second rod-like link member 320 pivotally connected between the other end of the first link member 316 and the lower end of the base member 314 by means of pins 322 and 324 so as to be vertically longitudinally swingable about the pin 322. The head section 300 is adapted to also act as a rear base means for supporting a rescue ladder provided on the rear portion of the toy vehicle which will be described hereinafter.

The arm sections 400 each comprise a stay member 408 connected through a pin 470 to the upper portion of the trunk body 270 so as to be horizontally swingable about the pin 470, a joint member 472 connected to the stay member 408 by means of a pin 474 in a manner to horizontally insert the stay member 408 therein and be horizontally swingable about the pin 474, an upper arm member **418*a* connected to the joint member 472 so as to be longitudinally vertically swingable, a lower arm member 418*b* connected to the lower end of the upper arm member 418*a* so as to be vertically longitudinally swingable, and a hand member 420 connected to the lower end of the lower arm member 418*b* so as to be detachable and horizontally swingable with respect to the lower arm member 418*b*. The arm section 400 is adapted to constitute the upper periphery of the central portion of the toy fire engine formed by folding the toy assembly 100**.

The leg sections 500 are fixedly secured to the lower end of a waist member 218 which is pivotally connected through a pin 540 to the lower end of the trunk body 270 to allow the leg sections 500 to be vertically longitudinally swung together through the waist member 218 with respect to the trunk body. Each of the leg sections 500 is adapted to form a central chassis of the fire engine configured when the toy assembly is folded.

The foot sections 600 each are pivotally connected through a pin 614 to the lower end of the corresponding leg section 500 so as to be vertically longitudinally swingable about the pin 614 with respect to the leg section 500 and is adapted to constitute a rear chassis and a rear wheel of the toy fire engine.

The back section 800 comprises a base member 802 fixedly mounted on the base member 314 of the head section 300 by means of a screw 804 so as to be vertically longitudinally swingable through the head section 300 and a ladder member 806 connected through a pin 808 to the base member 802 so as to be longitudinally vertically swingable about the pin 808 with respect to the base member 802. The back section 800 is adapted to constitute a rescue ladder of the toy fire engine configured when the toy assembly is folded.

The toy assembly of the fourth embodiment constructed in the manner mentioned above is adapted to be operated in such a manner as described hereinafter.

The toy assembly folded to configure the fire engine shown in FIG. 15 is unfolded in turn as shown in FIG. 17 to be transformed into the robotic humanoid configuration shown in FIG. 16.

More particularly, the toy assembly 100 in the form of the toy fire engine shown in FIG. 15 is first unfolded in a manner to vertically swing the leg sections 500 constituting the central chassis of the fire engine in the clockwise direction in FIG. 17 together with the waist member 218 to allow the leg sections 500 to be in a state downwardly extending from the lower side of the trunk section 200. Then, the foot sections 600 each constituting the rear chassis and rear wheel of the toy fire engine are vertically forwardly swung so as to be perpendicular to the leg sections 500 and look forward in a horizontal state. Further, the arm sections 400 each constituting the upper periphery of the central portion of the fire engine are horizontally outwardly swung together with the stay member 408, horizontally outwardly swung together with the joint member 472, and then vertically swung with respect to the joint member 472, so that the arm sections are in an upright state on the both sides of the trunk section 200. Furthermore, the head section 300 also acting as the rear base means for supporting the back section is vertically upwardly swung and moved to be in a state of being disposed on the upper side of the trunk section 200. Finally, the back section 800 is vertically backwardly swung to be upright along the rear portion of the trunk section 200. Thus, the toy assembly 100 is transformed from the fire engine configuration shown in FIG. 15 into the robotic humanoid configuration shown in FIG. 16.

Reconfiguration of the toy assembly 100 from the robotic humanoid form to the fire engine configuration can be readily carried out by operating the assembly in a manner reverse to that described hereinbefore. Thus, it will be noted that the toy assembly can be reversibly transformed between the fire engine configuration and the robotic humanoid configuration which are highly different in appearance from each other.

The fire engine configuration obtained by folding the toy assembly of the fourth embodiment is the six-wheel cab-over engine truck type, however, it may be configured into a six- or eight-wheel cab-over engine truck, a cab-behind-engine truck or the like.

Also, in the toy assembly of the embodiment, the leg sections 500 are swingably connected through the waist section 218 indirectly to the trunk section 200, however, the embodiment may be constructed in a manner to pivotally mount the leg sections 500 directly with respect to the trunk section 200.

As can be seen from the foregoing, the present invention is capable of being unexpectedly transformed between a vehicle configuration and a robotic humanoid configuration entirely different from each other, to thereby provide pleasant surprise and interest. The present invention is also capable of carrying out the transformation by only swinging motion, to thereby readily accomplish the operation. Also, in the toy assembly of the present invention, the parts are securely and foldably connected to one another, thus, the present invention is capable of effectively preventing loss of the parts. Furthermore, the present invention has still a further advantage of being easily manufactured with low costs because it is simple in construction.

It will thus be seen that the objects of the present invention set forth above among those other objects, made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A reconfigurable toy assembly having a vehicle configuration in a first position and a robotic humanoid configuration in a second position, comprising:

a first element configured to simulate the front portion of a vehicle in a first position and a robotic humanoid trunk in a second position;

a second element swingably mounted on the upper portion of said first element, said second element being configured to simulate a robotic humanoid head in a second position and received in said first element in a first position;

a pair of third elements pivotally connected to two sides of said first element, said third elements being configured to simulate a lower portion and front wheel portion of a vehicle in a first position and a pair of robotic humanoid arms in a second position;

a pair of fourth elements pivotally connected to the lower portion of said first element, said fourth elements being configured to simulate a pair of robotic humanoid legs in a second position and received in said first element in a first position; and a pair of fifth elements each pivotally connected to the lower portion of the corresponding fourth element.

2. A reconfigurable toy assembly as defined in claim 10 further comprising a sixth element pivotally connected to the lower portion of said first element, said sixth element being configured to simulate a robotic humanoid waist in a second position and received in said first element in a first position, said fourth elements being securely fixed to the lower portion of said sixth element.

3. A reconfigurable toy assembly having a vehicle configuration in a first position and a robotic humanoid configuration in a second position, comprising:

a first element configured to simulate the front portion of a vehicle in a first position and a robotic humanoid trunk in a second position;

a second element pivotally and movably connected to said first element, said second element being configured to simulate a robotic humanoid head in a second position and received in said first element in a first position;

a pair of third elements pivotally connected to two sides of said first element, said third elements being configured to simulate a lower portion and front wheel portion of the vehicle in a first position and a pair of robotic humanoid arms in a second position;

a fourth element connected to said first element so as to be vertically swingable and horizontally rotatable with respect to said first element, said fourth element being configured to simulate a robotic humanoid waist in a second position and received in said first member in a first position;

a pair of fifth elements each extensibly connected to the lower side of said fourth element, said fifth elements being configurated to simulate a pair of robotic humanoid legs in a second position and received in said first element in a first position; and a pair of sixth elements each pivotally connected to the lower end of a corresponding fifth element, said sixth elements being configured to simulate the rear portion and rear wheel portion of the vehicle in a first position and a pair of robotic humanoid feet in a second position.

4. A reconfigurable toy assembly comprising:

a frame member;

means mounted on the assembly for translating the toy assembly across a support surface, and a housing member providing in a first position a simulated vehicle body configuration, movably connected to the frame member, the housing member is divided into component parts that are movably interconnected, reconfiguration of the housing member component parts from the vehicle body configuration of the first position provides a second position simulating a robotic humanoid, at least a first component housing part can be bifuracated to simulate feet of a robotic humanoid, at least a second component housing part can be repositioned to simulate the chest of a robotic humanoid and a third component housing part supports a simulated humanoid robot head member, the first component housing part when configured in the second position is moved relative to the frame member and separated to simulate the robotic humanoid feet, the second component housing part is moved relative to the frame member above the first component housing part to form a chest and the third component housing part is positioned above the second component housing part to provide the head.

5. The invention of claim 4 wherein the housing member includes a front hood member as the second component and the head member is pivotally attached to a portion of the hood member.

6. The invention of claim 4 wherein the frame member supports the means for translating and is divided into component parts, a pair of the component parts is movable to form simulated arm appendages in the second position of simulating a robotic humanoid.

7. The invention of claim 4 wherein the first component housing part simulates the rear end of a vehicle configuration.

8. The invention of claim 4 wherein the frame member can be moved linearly relative to a component part of the housing member.

9. The invention of claim 6 wherein the means for translating includes a pair of front wheels, one rotatably connected to each frame component part that simulates an arm appendage.

10. The invention of claim 7 wherein the first component housing part is separted and moved linearly apart when operatively simulating the feet of a robotic humanoid.

* * * * *